US005733113A

United States Patent [19]

Grupping

[11] Patent Number: 5,733,113

[45] Date of Patent: Mar. 31, 1998

[54] DOWNHOLE ROLLER VANE MOTOR AND ROLLER VANE PUMP

[76] Inventor: Arnold W. J. Grupping, 3 Anjelierenlaan, 2111 BP Aerdenhout, Netherlands

[21] Appl. No.: 448,553

[22] PCT Filed: Jan. 3, 1994

[86] PCT No.: PCT/NL94/00001

§ 371 Date: Sep. 25, 1995

§ 102(e) Date: Sep. 25, 1995

[87] PCT Pub. No.: WO94/16198

PCT Pub. Date: Jul. 21, 1994

[30] Foreign Application Priority Data

| | | | |
|---|---|---|---|
| Jan. 7, 1993 | [NL] | Netherlands | 9300029 |
| Sep. 15, 1993 | [NL] | Netherlands | 9301594 |
| Dec. 14, 1993 | [NL] | Netherlands | 9302176 |

[51] Int. Cl.[6] ..... F03C 2/22; F04C 2/344; F04C 11/00

[52] U.S. Cl. ..... 418/188; 418/225; 417/405; 175/107

[58] Field of Search ..... 418/1, 185, 188, 418/225; 417/405, 406, 408, 410.3; 175/107

[56] References Cited

U.S. PATENT DOCUMENTS

| | | | |
|---|---|---|---|
| 855,590 | 6/1907 | Ripberger | 418/225 |
| 929,018 | 7/1909 | Ripberger | 418/225 |
| 2,065,008 | 12/1936 | Maple | 418/225 |
| 2,910,948 | 11/1959 | Betzen | 417/405 |
| 2,992,616 | 7/1961 | Rineer | 418/225 |
| 3,143,078 | 8/1964 | Gaslow et al. | 417/406 |
| 3,677,665 | 7/1972 | Corkill | 417/410.3 |
| 5,320,500 | 6/1994 | Cholet | 417/405 |

FOREIGN PATENT DOCUMENTS

| | | | |
|---|---|---|---|
| 14516 | 5/1926 | Netherlands | 417/405 |

*Primary Examiner*—John J. Vrablik
*Attorney, Agent, or Firm*—Edmund M. Jaskiewicz

[57] ABSTRACT

A roller vane motor for downhole drilling comprises a housing and a rotor. The housing contains outlet ports and wing deflector cams that divide the space between housing and rotor into chambers. The rotor is provided with recesses in its periphery and there are cylindrical rollers in these recesses which rollers can move between an extended and a retracted position. A portion of the drilling mud that flows through a central conduit in the rotor passes through inlet ports and the recesses into the chamber portions and pushes rollers into their extended position and in a clockwise direction to thus make the rotor turn. Drilling mud of a lower pressure is pushed in from the corresponding chamber portion through the outlet ports into the annular space between the motor and the bore hole wall. When the rollers reach the wing deflector cams, they are forced into the retracted position and their subsequent tasks are then taken over by successive rollers.

14 Claims, 4 Drawing Sheets

DOWNHOLE ROLLER VANE MOTOR AND ROLLER VANE PUMP

Figure 1:
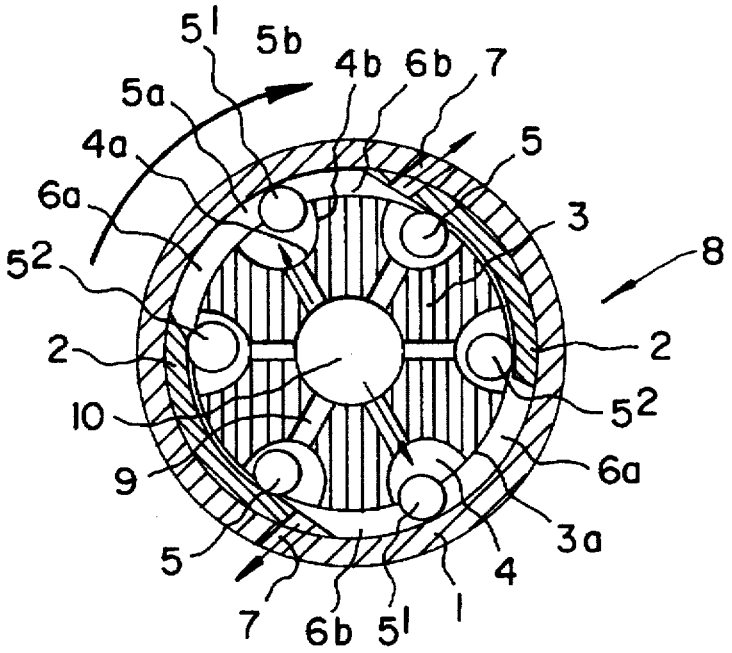

The invention relates to a hydraulically or pneumatically driven roller vane motor for directional including horizontal and straight hole drilling and cleaning/repairing and to a roller vane pump for pumping oil and/or water from a subterranean reservoir to the ground surface or for pumping up water from a surface water reservoir. To drive drill bits, it is known to use a roller vane motor located on the drill string above the bit, which motor is driven by the drilling mud that is pumped through the drill string to lubricate and cool the bit and carry drill cuttings back to the ground surface through the annular space between the drill string and the borehole wall. Roller vane motors are described in U.S. Pat. No. 2,725,013, GB A 2,201,734, WO-A-9214037 and WO-A-9308374. The known roller vane motors for use in drilling have both an outer and an inner h6using, the annulus between these housings being closed off halfway down the motor by a barrier. Part of the drilling mud is pumped down through this annulus, enters chambers between the motor and the inner housing through inlet ports in the inner housing above the barrier and leaves these chambers again through outlet ports in the inner housing below the barrier. Rollers, located in the extended position in recesses in the rotor, are pushed by the drilling mud in the chambers between rotor and inner housing from the inlet ports towards the outlet ports in a clockwise direction. Rollers that are located between outlet ports and inlet ports are not subjected to any rotational and pressure since they have been forced into a retracted position by longitudinally extending wing deflector cams along the interior wall surface of the inner housing. The rollers are forced into contact with the interior wall surface of the inner housing by the pressure of the drilling mud acting on the rear ends of the rollers. In WO-A-9214037 part of the pressure of the drilling mud acts through ports in the rotor that connect the recesses with a central conduit in the rotor, through which the remainder of the drilling mud flows from the drill string to the drill bit.

The present invention provides an improved roller vane motor and roller vane pump resulting in a simpler construction, a larger diameter of the rotor for a given outside diameter of the motor, reduced friction losses and more torque. In addition, these motors and pumps are easier to repair and maintain.

To this end, the roller vane motor according to the present invention may comprise a roller vane motor for downhole drilling having a housing and a rotor. The housing contains outlet ports and wing deflector cams that divide the space between housing and rotor into chambers. The rotor is equipped with cylindrical rollers in recesses which rollers can move between an extended and retracted position. Part of the drilling mud that flows through a central conduit in the rotor passes through inlet ports and the recesses into chamber portions and pushes the rollers into their extended position and in a clockwise direction, making the rotor turn, while drilling mud at a lower pressure is pushed from the corresponding chamber portion through the outlet port into the annulus between the motor and the borehole wall. When the rollers each the wing deflector cams, they are forced into retracted positions and their tasks then being taken over by the successive rollers. In addition, the present invention provides a special roller vane motor for use as a production motor to drive a downhole rotating pump, and a special roller vane pump. Finally, the present invention provides methods and systems for the use of the pumps and motors of the present invention.

Figure 2:
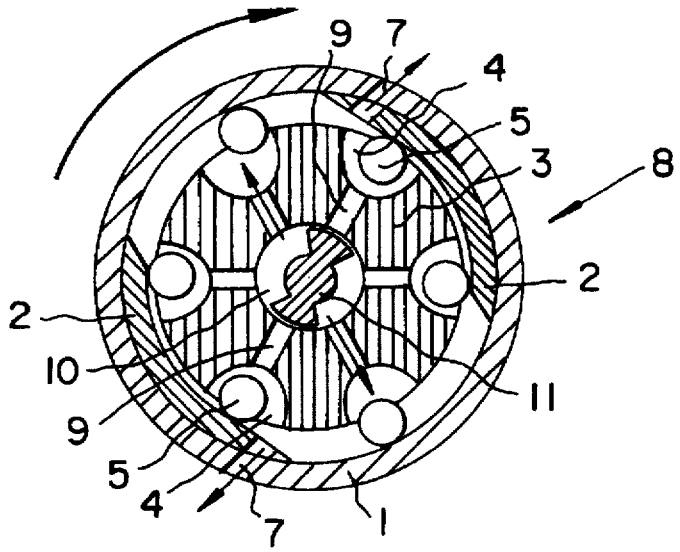
Figure 3:
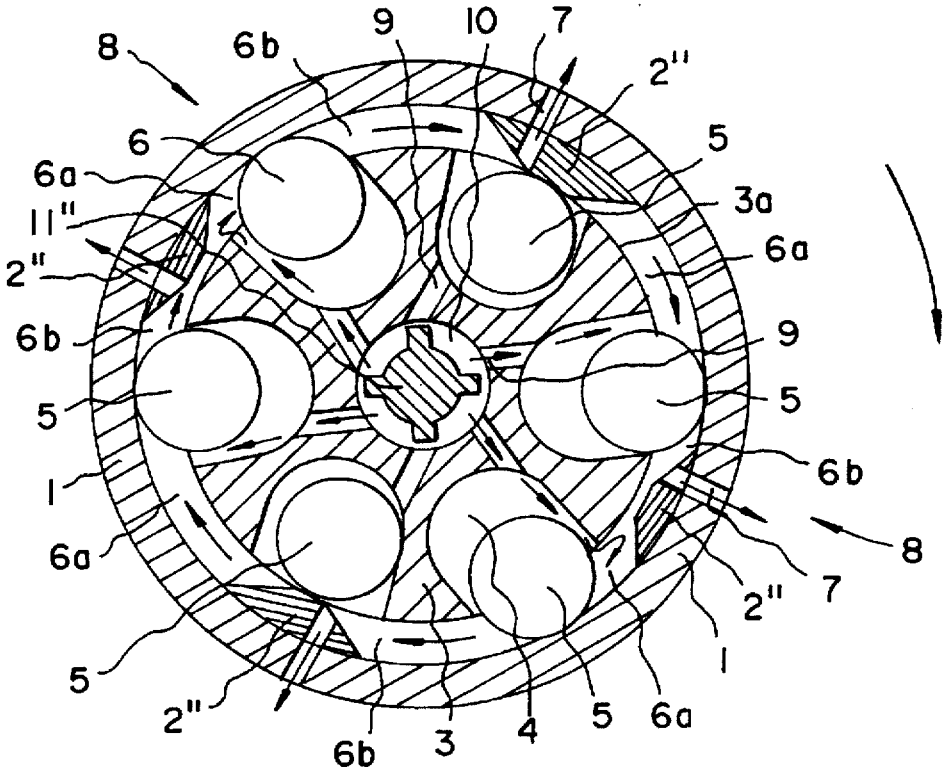
Figure 4:
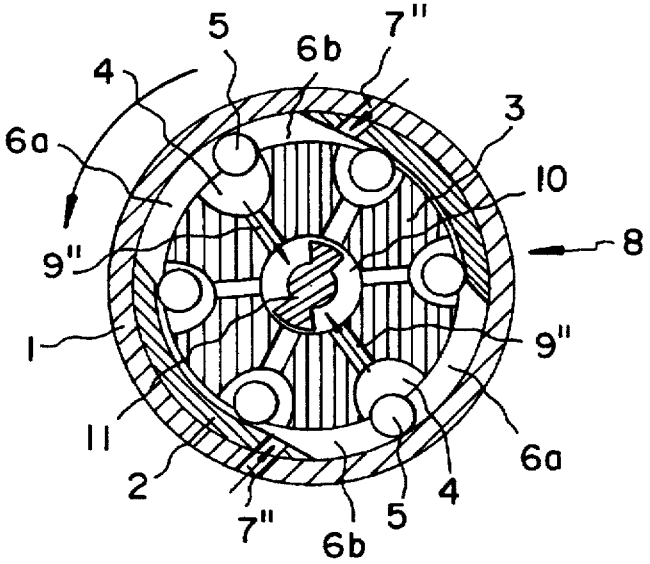
Figure 5:
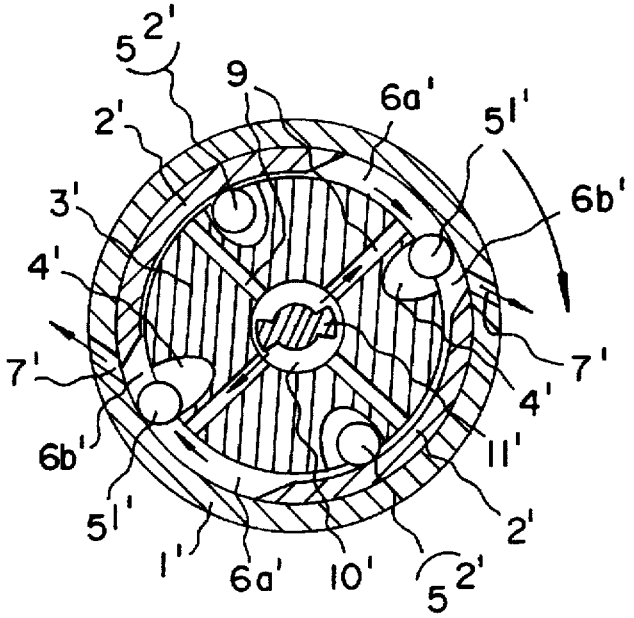
Figure 6:
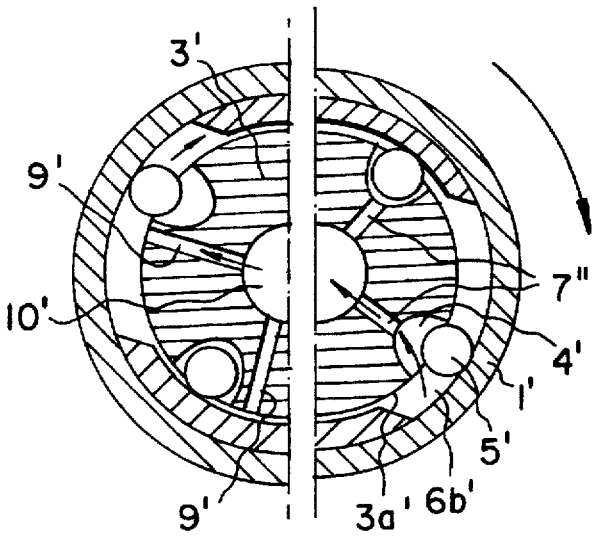
Figure 7:
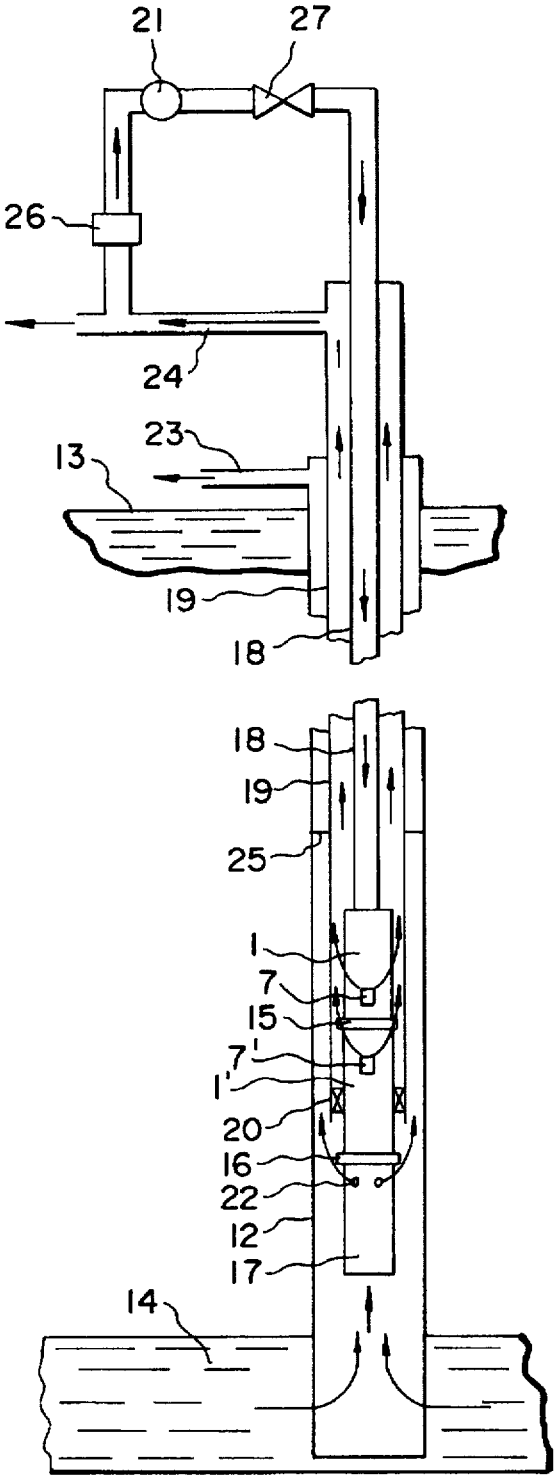
Figure 8:
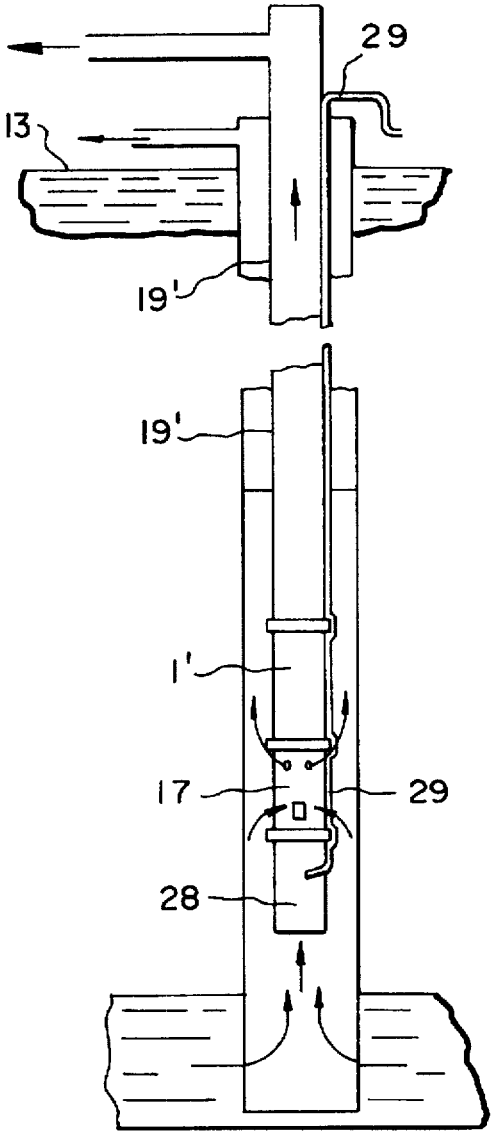

The present invention will be elucidated below in more detail with reference to a drawing, showing in:

FIG. 1, FIG. 2 and FIG. 3 transverse sectional views from above of roller vane motors according to the present invention;

FIG. 4, FIG. 5 and FIG. 6 transverse sectional views from above of roller vane pumps according to the present invention;

FIG. 7 and FIG. 8 schematic side-views of pump systems with a roller vane pump according to the present invention driven by a roller vane motor according to the present invention and driven by an electromotor.

Referring to FIG. 1, a roller vane motor according to the present invention comprises a tubular housing 1 with two radially inwardly projecting wall means in the form of longitudinally extending wing deflector cams 2, which together form a stator for the roller vane motor, and a rotor 3 running in bearings in bearing houses (not shown) at either end of said rotor 3. The longitudinally extending wing deflector cams 2 together occupy about half the circumference of the housing 1. The rotor 3 is connected at its lower end by suitable means to a drill bit and the housing 1 is connected at its Upper end by suitable means to a (non-rotating) drill string. The rotor 3 is provided with three pairs of diametrically opposed and circumferentially spaced slots in the form of roundbottommed recesses 4, in which are disposed elongate longitudinally extending wings in the form of cylindrical rollers 5. The recesses 4 are substantially wider than the diameter of the rollers 5. The rollers 5 are movable between retracted positions in which they are fully or largely contained within the recesses 4 and radially projecting positions in which they partly project from the other surface **3*a* of the rotor 3. Each roller 5 is made of resiliently deformable polymeric material. A generally annular space, defined between the rotor 3 and the housing 1, is divided by the two diametrically opposed wing deflector cams 2 into two. chambers 6*a*,*b*. Each of said chambers 6*a*,*b* is connected to one or more outlet ports 7 in the housing i for the passage of drilling mud therethrough to the annulus 8 between the housing 1 and the borehole wall, as indicated by the arrows thereat, said outlet ports 7 being positioned at or near the front edge of the wing deflector cams 2, when viewed in a clockwise direction. The base 4*a* of each recess 4 in the rotor 3 is provided with one or more inlet ports 9, leading from a central conduit 10 extending along the rotor 3, which inlet ports 9 direct part of the drilling mud against the rear side of the rollers 5 thereby pressing them against the housing 1 and the wing deflector cams 2. Simultaneously, because the pressure of the drilling mud in the central conduit 10 in the rotor 3 is higher than that of the drilling mud in the annulus 8 between the housing 1 and the borehole wall, the rollers $5^1$ that are positioned in the chambers 6*a*,*b* are also pressed against the downstream sides 4*b* of the recesses 4 in the rotor 3, thereby dividing the chambers 6*a*,*b* into high-pressure parts 6*a* and lower-pressure parts 6*b*. The two first rollers $5^1$ are thus exposed to high-pressure drilling mud at their upstream side 5*a*, entering through the inlet ports 9, thereby exerting a clockwise (as viewed in FIG. 1) turning moment on the rotor 3. Two other pairs of rollers are pressed down into their retracted positions in the recesses 4 in the rotor 3 by the wing deflector cams 2. Additional ports 7 and 9 can thus be added in corresponding circumferential positions and situated at different levels along the central axis. Said ports are connected in parallel with the ports 7 and 9 respectively as shown in the drawings. When the rotor 3 has turned approximately 30 degrees further in the clockwise direction under the influence of the mud pressure op the first mentioned rollers $5^1$ in the chamber parts 6a, the retracted rollers 5 will clear the wing deflector cams 2 and be resiliently restored into their projecting positions with their upstream side exposed to the pressure of the drilling mud entering through the inlet ports 9 in the rotor 3 thereby ensuring a continuous driving and rotating force on the rotor 3 with a torque substantially directly proportional to the pressure difference in the drilling mud between the upstream chamber parts 6a and the downstream chamber parts 6b. The drilling mud in the chamber parts 6b is compressed between the advancing leading faces 5b of the rollers $5^1$ and the respective opposing wing deflector cams 2 and is expelled through the outlet ports 7 into the annular space 8 between the housing 1 and the borehole wall. It will of course be appreciated that the rollers 5 will in practice tend to roll as the rotor turns, thereby passing over any particulate matter trapped between the rollers 5 and the housing 1 or the wing deflector cams 2 without damage thereto. The improvement of the present invention thus consists of widening the radially extending ports 9 and recesses 4 in the rotor 3 so that, in addition to forcing the rollers into contact with the inner wall surface of the housing 1 and the wing deflector cams 2**, they will also act as inlet ports for the drilling mud that pushes the rollers to rotate the rotor, thereby taking over the function of the inlet ports in the wall of the inner housing. As a result, the inlet ports in the wall of the inner housing can be omitted. As all the drilling mud now enters through the central conduit in the rotor, the inner housing is now also superfluous, as is the barrier between inner and outer housing halfway down the motor. The result is that the portion of the drilling mud that pushes the rollers flows directly into the annulus between motor and borehole wall instead of passing through the drill bit.

After a roller 5 has reached an outlet port 7 and before it is being displaced in a clockwise direction into the fully retracted position opposite a wing deflector cam 2, part of the drilling mud can flow freely from the central conduit 10 in the rotor 3 to the annulus 8 between the housing 1 and the borehole wall via the corresponding inlet port 9 and recess 4, without doing any useful driving action on this roller 5. This flow can be eliminated or reduced by installing radially outwardly projecting valve means 11 in the central conduit 10 in the rotor 3 as schematically depicted in FIG. 2. Said valve means 11 are fixed to the housing 1 and/or the bearing house of the rotor 3, at one or both ends of the motor. When the rotor 3 rotates, these valve means 11 temporarily become positioned opposite the inlet ports 9 that correspond to said rollers 5 and partly or wholly shut off said free flow of drilling mud from the central conduit 10 in the rotor 3 towards the annulus 8 between the housing 1 and the borehole wall. Advantageously, the outer surface of these valve, means 11 is curved with the same radius of curvature as the central conduit.

It will be appreciated that not all the drilling mud flow passes through the roller vane motor into the annulus between motor and borehole wall, but that part of this mud flow is needed for cooling and lubricating the drill bit and for removing drill cuttings from the bottom of the borehole. To allow for variations of the distribution of the drilling mud flow between the motor and the drill bit, suitable throttle or nozzle means, such as e.g. a flowbean, may be installed in the central conduit 10 in the rotor 3 in the valve means 11.

The recesses 4 can have various shapes and the inlet ports can debouch into them at various places. It will further be appreciated that the motor may not only be used for drilling or coring purposes, but also to repair and clean boreholes. Thus, the working fluid need not exclusively be drilling mud but can also consist of other liquids such as e.g. oil or water, a gas/liquid mixture, or a gas such as e.g. air.

In the embodiment shown in FIG. 1 only two of six rollers experience the pushing and rotating force of the drilling mud. This problem can be solved by employing the embodiment shown in FIG. 3. In this embodiment the wing deflector cams 2 have been considerably narrowed to wing deflector cams 2" and their number has been increased to four, spaced at equal distance along the interior surface of the housing 1, each one at its front edge provided with an outlet port 7. The result is that the number of chambers 6a,b between the rotor 3 and the housing 1 increases so that more rollers 5 are exposed to the pushing and rotating force of the drilling mud in the chamber parts 6a. In the example of FIG. 4 four rollers are exposed to the force of the drilling mud simultaneously. As a result, with equal pressure drop across the rollers 5 in the chambers 6a,b, the motor produces twice the torque and passes twice the amount of drilling fluid. On the other hand, this motor will produce the same torque and pass the same amount of drilling mud as the motor shown in FIG. 1 when the pressure drop across it is halved. Its rotating speed will then also be halved. Preferably, in this embodiment with narrow wing deflector cams 2" the number of recesses 4 in the rotor 3 with matching rollers 5 should be at least one larger than the number of wing deflector cams 2" and preferably less than twice as large.

Roller vane motors as described above can also be used as roller vane pumps, as shown in FIG. 4. To this end, the central conduit 10 in the rotor 3 must be closed off at its lower end and the rotor 3 must be attached to and driven by a downhole electromotor (not shown) in a direction opposite to that of the described motor, as shown by a curved arrow in FIG. 4. Fluid is then sucked in from the annulus 8 outside the housing i through the outlet ports 7, that then become inlet ports 7", and is pumped by the rollers 5 via the chambers 6a,b, the radially extending recesses 4 and the inlet ports 9, that then become outlet ports 9", to the central conduit 10 in the rotor 3 and further via production tubing to the ground surface. Advantageously, valve means 11" are installed in the central conduit 10 in the rotor 3 to prevent pumped liquid from flowing back from the central conduit 10 through outlet ports 9" and recesses 4 into the lower-pressure chamber parts 6b when corresponding rollers 5 are at or near inlet ports 7". Said valve means 11" are only fixed to the upper, downstream end of the pump. The rotating speed of the pump can be adjusted to a desired value by changing the frequency of the electromotor. It will be appreciated that the embodiment of the roller vane motor shown in FIG. 3 can likewise be used as a pump. The roller vane motors for drilling purposes as shown in FIG. 1, FIG. 2 and FIG. 3 can also be used as a production motor for driving a rotating pump of the roller vane type or the centrifugal type. To that end the central conduit 10 in the rotor 3 must be closed off at its lower end so that all power fluid flows through the chambers of the motor.

At its upstream side the housing 1 of the production motor is attached to a power fluid supply tube that is connected to the ground surface. Downstream, at its lower side, the housing 1 and the rotor 3 are attached to the housing and rotor of a rotating pump. Power fluid and produced fluid from the subterranean reservoir are mixed and pumped to the ground surface through a production tube. Roller vane pumps according to the present invention can also be provided with an axial fluid inlet end a tangential fluid discharge, enabling the inlet to be attached to the discharge of a rotating gas/oil separator. This special embodiment is shown in FIG. 5 for a pump with four rollers and wide wing deflection cams. The central conduit 10' in the rotor 3' is then closed off downstream, at its upper end, and the rotor 3' is rotated in the direction as shown with a curved arrow. Liquid then enters the pump axially from below through the central conduit 10' in the rotor 3' and flows through inlet ports 9' into the chambers 6a', b' from where it is pumped by the rollers 5' through outlet ports 7' into the space outside the housing 1'. Radially outwardly projecting valve means 11' may also be installed, if desired, in this embodiment of the pump.

It will be appreciated that also in this embodiment of the roller vane pump a different number of rollers and/or wing deflector cams may be used.

FIG. 6 shows the pump of FIG. 5 whereby the outlet ports 7' in the housing 1' are replaced by outlet ports 7''' to the central conduit 10' in the rotor 3' downstream of the barrier in said central conduit 10', thereby changing the tangential outlet of the pump into an axial outlet. The left-hand side of FIG. 6 shows half a transverse sectional view of the pump below and upstream of said barrier. This section is comparable to that of FIG. 5. The righthand side shows half a transverse sectional view of the pump above and downstream of said barrier, illustrating how liquid is directed back by a roller 5' from a chamber part 6b' via a recess 4' through an outlet port 7''' to the central conduit 10' in the rotor 3'. FIG. 6 thus shows two cross-sections at different (axial) levels, and between these levels a barrier is arranged in the central conduit. As indicated with arrows and described on preceding page, the barrier in this conduit forces, at the upstream side, the liquid through the port 9' and, at the downstream side, the liquid flows through the port 7''' again to the central conduit. The outlet ports 7''' need not debouch into the recesses 4' but may also connect to the chamber parts 6b' at the outer surface 3a' of the rotor 3'. If desired, radially outwardly projecting valve means 11' may also be installed in the central conduit 10' in the rotor 3' of this special embodiment of the roller vane pump.

It will be appreciated that all the roller vane pumps described can be adapted in such a way that their direction of rotation is reversed.

FIG. 7 shows a pump system for producing oil and/or water from a subterranean reservoir to the ground surface, using a roller vane production motor according to the present invention, attached to a roller vane pump with tangential discharge according to the present invention.

The system consists of an outer casing 12 that runs from the ground surface 13 into a subterranean reservoir 14 where it has been perforated. The housing 1 of the roller vane production motor is attached to the housing 1' of the roller vane pump by a joint 15; the housing 1' of the roller vane pump is attached to the housing of a rotating gas/oil separator 17 by a joint 16. The rotors of the motor, pump and gas/oil separator have also been coupled (not visible). The motor is connected to the ground surface 13 by a power fluid supply tube 18. This supply tube 18 runs concentrically inside a production tube 19 through which the mixture of reservoir fluids and power fluid is pumped to the ground surface 13. Between the outlet ports 7' of the roller vane pump and the gas/oil separator 17 a barrier 20 has been introduced in the production tube 19 to prevent pumped liquid from flowing back to the suction of the gas/oil separator 17.

The operation of this system is as follows:

Power fluid is pumped by a high-pressure pump 21 at the ground surface 13 through the power fluid supply tube 18 to the roller vane production motor. The motor drives the roller vane pump so that liquid and gas from the reservoir 14 are sucked in axially through the inlet of the gas/oil separator 17. After having been separated, the gas leaves the separator 17 through outlet ports 22 and flows via the annulus between the outer casing 12 and the production tube 19 to the ground surface 13, where it is carried off through a pipe 23. The liquid flows axially into the central conduit in the rotor of the roller vane pump and leaves this pump again tangentially through the outlet ports 7'. Mixed with the power fluid, that leaves the roller vane production motor through outlet ports 7, the reservoir liquids are then pumped through the production tube 19 to a discharge pipe 24. A gas/liquid interface 25 establishes itself in the annulus between the outer casing 12 and the production tube 19. At the ground surface 13 part of the produced liquids is drawn off and, if necessary via a filter 26, pumped back to the roller vane production motor through the power fluid supply tube 18 by the high-pressure pump 21. The rotating speed of the roller vane production motor can be varied by changing the amount of power fluid with a valve 27 in the power fluid supply tube 18.

With this system, the pump/motor combination can be removed from the borehole and lowered into it, for instance for repair purposes, without removing the production tube 19. FIG. 8 shows a pump system for producing oil and/or water from a subterranean reservoir to the ground surface, using a roller vane pump according to the present invention, attached to a gas/oil separator 17 which in its turn is attached to an electromotor 28.

The electromotor 28 is connected with the ground surface 13 by an electric cable 29, attached to a production tube 19'. In this system there is no power fluid supply tube, so that a roller vane pump with axial discharge from the central conduit in the rotor to the production tube 19' can be used. Said production tube 19' is connected directly to the housing 1' of the pump.

The operation of this system is similar to that of the system shown in FIG. 7. The rotating speed of the electromotor 28 can be varied by changing the electric frequency at the ground surface 13. In this system the pump/motor combination cannot be removed from the borehole without also removing the production tube 19'.

If little or no gas is produced with the reservoir liquids, the gas/oil separator can in both systems described be omitted. In the system with roller vane production motor and roller vane pump, shown in FIG. 7, the production tube 19 could then also be omitted, in which case the pump is sealed off against the outer casing 12.

An important advantage of systems as shown in FIG. 7, with combined roller vane motor and pump, is the short length of such a combination, which allows it to be used in strongly curved boreholes where electromotors and other rotating pumps cannot be used because of their length.

It will be appreciated that various other embodiments of the described pump systems are possible. For instance, the power fluid can be supplied through a parallel instead of a concentric supply tube. Also, the liquids need not be mixed but may be pumped to the ground surface separately. In that case a separate discharge tube is required for the power fluid.

Motors and pumps according to the present invention may be used for various purposes with various fluids. The drilling motors are not only suitable for vertical and deviated drilling but also for coring and well cleaning/repair purposes and the present invention includes within its scope drilling, coring and cleaning/repair apparatus wherein motors of the present invention are used, as well as methods of driving drilling, coring and cleaning/repair apparatus using a motor of the present invention.

The production motors and pumps are not only suitable for oilfield use but can also be used for producing drinking water, for producing hot water in geothermal projects, or for producing drain water in mining operations such as for instance surface browncoal mining. They can also be employed in firefighting and cooling water installations at offshore platforms using seawater.

The invention includes within its scope therefore both oil and water production installations in which rotors and/or pumps of the present invention are used as well as methods to produce water from a subterranean reservoir to the ground surface or to pump up water from a surface water reservoir using a motor and/or pump of the present invention.

I claim:

1. Roller vane motor for use in a borehole for driving a rotatable tool for downhole drilling comprising a generally tubular housing (1) and a rotor (3) mounted for rotation within said housing to define an annular space therebetween, said housing having radially inwardly projecting wall means (2) extending longitudinally along said housing and dividing said annular space into a plurality of chambers (6*a*, *b*) each of said chambers having a first portion (6*a*) and a second portion (6*b*) such that said first portion is upstream of said second portion viewed in a clockwise direction, said rotor having a plurality of recesses (4) therein spaced around the circumference of said rotor and extending substantially over its length, a plurality of cylindrical rollers (5) disposed in said recesses so as to be displaceable in said recesses from a generally radially projecting position into substantially sealing engagement with the housing (1) to a generally retracted position when traversing the radially extending wall means (2), there being a central conduit (10) extending axially within said rotor (3) for the entering flow of pressurized fluid there through, inlet ports (9) in sad rotor (3) communicating between said central conduit (10) and said recesses (4), there being outlet ports (7) in said housing (1) at near the front edges of said inwardly projecting wall means (2) when viewed in the clockwise direction, said outlet ports open into an annular space defined by said housing and a wall of the borehole, said recesses being substantially wider than the diameters of said rollers (5) therein, such that a pressurized fluid flows unimpeded through said inlet ports (9) into said chambers (6*a*,*b*) such that the flow of pressurized fluid in a first chamber portion (6*a*) acts against an upstream side of a said roller (5) so as to rotate said rotor while expelling fluid from said second chamber portion (6*b*) at the downstream side of said roller until said roller is urged into a retracted position by said radially projecting wall means (2) and a successive roller clears the wall means (2) to be urged into an extended position by said fluid.

2. Roller vane motor as claimed in claim 1 wherein each inlet port (9) in the rotor (3) from the central conduit (10) to a recess (4) comprises a plurality of discreetly formed and longitudinally arranged inlet ports (9).

3. Roller vane motor as claimed in claim 1 wherein each outlet port (7) in the housing (1) to the annular space (8) between the housing and the borehole wall comprises a plurality of discreetly formed and longitudinally arranged outlet ports (7).

4. Roller vane motor for driving a rotating pump, as claimed in claim 1 wherein the central conduit (10) in the rotor (3) is, closed off at its lower end, the rotor (3) is joined to a rotor of a rotating pump and the housing (1) is joined to the housing of said pump.

5. Roller vane motor as claimed in claim 1 wherein the width of the radially inwardly projecting wall means is of the order of 2 inches and a plurality are spaced at equal distances along the interior surface of the housing (1), the number of recesses (4) with matching rollers (5) located at the outer surface (3*a*) of the rotor (3) being at least one greater than the number of narrowed wall means (2") and less than twice as large.

6. Roller vane motor as claimed in claim 5 wherein the central conduit (10) in the rotor (3) has a non-rotating radially outwardly projecting and longitudinally extending valve means (11) that partly or wholly close off an inlet port (9) in said rotor (3) from the time that its corresponding roller (5) reaches an outlet port (7) in the housing (1) until said roller (5) is displaced further towards the retracted position opposite the radially inwardly projecting wall means (2,2").

7. Roller vane pump suitable for pumping oil and/or from a subterranean reservoir to the ground surface, or for pumping up water from a service reservoir comprising a generally tubular housing (1) and a rotor (3) mounted for rotation within said housing to define an annular space there between, said housing having radially inwardly projecting wall means (2) extending longitudinally along said housing and dividing said annular space into a plurality of chambers (6*a*,*b*) each of said chambers having a first portion (6*a*) and a second portion (6*b*) such that said first portion is upstream of said second portion viewed in a clockwise direction, said rotor having a plurality of recesses (4) therein spaced around the circumference of said rotor and extending substantially over its length, a plurality of cylindrical rollers (5) disposed in said recesses so as to be displaceable in said recesses from a generally radially projecting position into substantially sealing engagement with the housing (1) to a generally retracted position when traversing the radially extending wall means (2), there being a central conduit (10) extending axially within said rotor (3) for the entering flow of pressurized fluid there through, outlet ports (9") in said rotor (3) communicating between said central conduit (10) and said recesses (4), there being inlet ports (7") in said housing (1) at or near the front edges of said inwardly projecting wall means (2) when viewed in the clockwise direction, said inlet ports open into an annular space defined by said housing and a wall of the borehole, said recesses being substantially wider than the diameters of said roller (5) therein, the central conduit (10) in the rotor (3) being closed at its lower end, an electromotor attached to said rotor (3) for rotating said rotor to pump oil or water by the rollers (5) from the annular space (8) outside the housing (1) through the inlet ports (7") through the chambers (6*a*,*b*), the recesses (4) and the outlet ports (9") to the central conduit (10) in the rotor and further through the well tubing to the ground surface.

8. Roller vane pump as claimed in claim 7, wherein the central conduit (10) in the rotor (3) has a non-rotating radially outwardly projecting and longitudinally extending valve means (11) that partly or wholly close off an outlet port (9") in said rotor (3) from the time that its corresponding roller (5) reaches an inlet port (7") in the housing (1) until said roller (5) is displaced further towards the projecting position opposite the interior wall surface of said housing (1).

9. Roller vane pump for pumping oil and/or water from a subterranean reservoir to the ground surface or for pumping up water from a service reservoir, comprising a generally tubular housing (1) and a rotor (3') mounted for rotation within said housing to define an annular space there between, said housing having radially inwardly projecting wall means (2) extending longitudinally along said housing and dividing said annular space into a plurality of chambers (6*a*',*b*') each of said chambers having a first portion (6*a*') and a second portion (6*b*') such that said first portion is upstream of said second portion viewed in a clockwise direction, said rotor having a plurality of recesses (4') therein spaced around the circumference of said rotor and extending substantially over its length, a plurality of cylindrical rollers (5') disposed in said recesses so as to be displaceable in said recesses from a generally radially projecting position into substantially sealing engagement with the housing (1') to a generally retracted position when traversing the radially extending wall means (2'), there being a central conduit (10') extending axially within said rotor (3') for the entering flow of pressurized fluid there through, inlet ports (9') in said rotor communicating between said central conduit (10) and recesses (4'), there being outlet ports (7') in said housing (1') at or near the front edges of said inwardly projecting wall means (2') when viewed in the clockwise direction, said outlet ports open into an annular space defined by said housing and a wall of the borehole, said recesses being substantially wider than the diameters of said rollers (5') therein, such that in the use of the pump liquid is sucked in through sad inlet ports (9') from the central conduit (10') into chamber portion (6*a*') near the recesses (4') and is discharged through outlet ports (7') disposed at or near the front edges of the radically inwardly projecting wall means (2') when viewed in a clockwise direction to the space outside the housing (1') until said rollers (5") are forced into the retracted position by the radially inwardly projecting wall means (2') and successive rollers (5') clear the radially inwardly projecting wall means (2') and assume the extended position where upon said process is repeating whereby said central conduit (10') in the rotor (3') is closed off at its downstream, upper side.

10. Roller vane pump as claimed in claim 9 wherein each inlet port (9') in the rotor (3') leading from the central conduit (10') to a chamber part (6*a*') comprises a plurality of discreetly formed and longitudinally arranged inlet ports (9').

11. Roller vane pump as claimed in claim 9 wherein the central conduit (10') in the rotor (3') comprises non-rotating radially outwardly projecting and longitudinally extending valve means (11') for partly or wholly closing off an inlet port (9') in said rotor (3') from the time that its corresponding roller (5') reaches an outlet port (7') in the housing (1') until said roller (5') has passed said outlet port (7').

12. Roller vane pump as claimed in claim 9 wherein each outlet port (7') in the housing (1') to the space outside said housing (1') comprises a plurality of discreetly formed and longitudinally arranged outlet ports (7').

13. Roller vane pump as claimed in claim 12 Wherein the outlet ports (7') in the housing (1') are replaced by outlet ports (7"') downstream of the point where the central conduit (10') of the rotor (3') is closed off, such that said outlet ports (7"') lead from the recesses (4') or from the outer surface (3*a*') of the rotor (3') to said central conduit (10') in the rotor (3').

14. Roller vane pump as claimed in claim 13, wherein each outlet port (7"') to the central conduit (10') in the rotor (3') comprises a plurality of discreetly founded and longitudinally arranged outlet ports (7"').

* * * * *